US006310031B1

(12) United States Patent
Sliva

(10) Patent No.: US 6,310,031 B1
(45) Date of Patent: Oct. 30, 2001

(54) METHOD OF INHIBITING SOIL REDEPOSITION

(75) Inventor: Philip G. Sliva, Rockford, MI (US)

(73) Assignee: Amway Corporation, Ada, MI (US)

( * ) Notice: Subject to any disclaimer, the term of this patent is extended or adjusted under 35 U.S.C. 154(b) by 0 days.

(21) Appl. No.: 09/451,477

(22) Filed: Nov. 30, 1999

(51) Int. Cl.[7] ..... C11D 3/37
(52) U.S. Cl. ..... 510/528; 510/475
(58) Field of Search ..... 510/475, 476, 510/528

(56) References Cited

U.S. PATENT DOCUMENTS

| | | | | |
|---|---|---|---|---|
| 4,663,053 | | 5/1987 | Geiger . | |
| 4,698,161 | | 10/1987 | Hansen . | |
| 4,711,740 | * | 12/1987 | Carter et al. | 252/174.24 |
| 4,941,946 | | 7/1990 | Henn et al. . | |
| 5,196,139 | * | 3/1993 | Moschner | 252/186.25 |
| 5,429,765 | | 7/1995 | Flower . | |
| 5,456,854 | | 10/1995 | Flower . | |
| 5,489,397 | * | 2/1996 | Bainbridge | 252/174.24 |
| 5,496,486 | | 3/1996 | Staley . | |
| 5,635,467 | | 6/1997 | Staley . | |
| 5,925,610 | * | 7/1999 | Austin et al. | 510/361 |

FOREIGN PATENT DOCUMENTS

| | | | |
|---|---|---|---|
| 877076 A2 | * | 11/1998 | (EP) . |
| 935733 | | 9/1963 | (GB) . |
| 2023121 | | 12/1979 | (GB) . |
| 2138439 | | 10/1984 | (GB) . |
| 62-141099 | | 6/1987 | (JP) . |
| WO 97/20024 | | 6/1997 | (WO) . |

OTHER PUBLICATIONS

Database WIP, Section CH, Week 198731, Derwent Publications Ltd., London, GB; Class A97, AN 1987–216333, XP002166009 & JP 62 141099 A (Lion Haijin KK) Jun. 24, 1987 (Jun. 24, 1987) abstract.

Chemical Abstracts, vol. 106, No. 24, Jun. 5, 1987 (Jun. 5, 1987); Columbus, Ohio, US; Abstract No. 19853a, Tamura C et al., "Studies on the Removal of Particulate Soil", p. 101; XP002166008 Abstract & Yukagaku, vol. 36, No. 3, 1987, pp. 192–199.

* cited by examiner

*Primary Examiner*—John Hardee
(74) *Attorney, Agent, or Firm*—Brinks Hofer Gilson & Lione; G. Peter Nichols

(57) ABSTRACT

A method of inhibiting soil redeposition on fabric stained by one or more quaternary compounds by providing a sulfonated material in an effective amount to a wash liquor. The sulfonated material includes water-soluble sulfonated polymers. Generally, the sulfonated material is incorporated with a laundry detergent to provide a use level of about 30 ppm to about 300 ppm in the wash liquor.

9 Claims, 3 Drawing Sheets

METHOD OF INHIBITING SOIL REDEPOSITION

It has long been recognized that personal care products such as hair and skin care products can cause serious staining problems on fabrics during laundering. When these products are inadvertently spilled on a fabric, they are generally not visible. During the laundering process, however, the area containing the personal care product tends to attract soil and dyes. Thus, after laundering, the area containing the personal care product becomes visible. This staining problem is particularly prevalent when the laundry detergent primarily contains nonionic surfactants as the active cleaning agent.

The staining problem is also exacerbated by high soil loading conditions that are typical in European markets. In these markets, low water volume front-loading washing machines are typical causing a high soil loading condition, particularly when compared to North American soil loading conditions due to the larger water volume machines.

After extensive investigation, it has been found that those personal care compositions that contain polyquaternary ingredients contribute to the staining phenomenon. As an example, it has been found that polyquaternary compounds such as Polyquaternium 4, 7, 16, and the like contribute to this problem. It has also been found that polysulfonated materials will prevent substantial soil redeposition on fabric that has been stained with polyquaternary compounds.

A laundry detergent that contained sulfonated styrene maleic anhydride ("SSMA") in an amount from about 1.9% to about 2.0% by weight of the total detergent composition was commercially available in North America and Japan in the early 1990s. The use dosages of these detergents, however, provided a SSMA concentration of less than 20 ppm in the wash liquor. This level would not provide an amount of the SSMA effective to prevent soil redeposition on fabric.

SUMMARY OF THE INVENTION

The present invention provides a method of removing polyquaternary compounds from fabric during laundering by providing an effective amount of a sulfonated material. The term effective amount refers to an amount of sulfonated material in the wash solution that will prevent substantially all redeposition of soil on the fabric and, in particular on fabric stained with one or more polyquaternary compounds.

The method includes adding a laundry detergent to wash water to form a wash liquid or liquor and providing an effective amount of a sulfonated material selected from the group of sulfonated and polysulfonated polymers, sulfonated and polysulfonated copolymers, and mixtures thereof. The sulfonated material preferably contains a degree of sulfonation greater than about 10%. Desirably, the sulfonated material is present in the wash solution (liquor) in amount from about 30 ppm to about 300 ppm, preferably from about 60 ppm to about 150 ppm.

It is believed that the sulfonated material can be incorporated with any suitable laundry detergent. It has been found, however, that the greatest benefit to the use of the sulfonated material is achieved when it is incorporated in a laundry detergent that primarily contains a nonionic surfactant as the main cleaning agent.

It is therefore an object of the present invention to provide a detergent composition containing a sulfonated material that is effective in reducing or eliminating the redeposition of soil on fabrics during laundering as a result of the presence of polyquaternary compounds.

The present invention also contemplates a wash liquor composition containing a laundry detergent composition and from about 30 ppm to about 300 ppm, preferably from about 60 ppm to about 150 ppm of a sulfonated material, wherein the sulfonated material is effective in preventing substantially all soil redeposition on fabric stained by one or more polyquaternary compounds. In general, the wash liquor contains from about 500 ppm to about 10,000 ppm laundry detergent, preferably from about 1,000 to about 7,000, more preferably from about 2,000 to about 4,000 ppm.

All percentages, ratios and proportions herein are on a weight basis unless otherwise indicated. All percentages herein are on a total weight basis unless otherwise indicated. All documents cited herein are hereby incorporated by reference.

DETAILED DESCRIPTION OF THE INVENTION

The present invention is directed to a method of inhibiting redeposition of soils on polyquaternary compounds on fabrics during laundering. In general, the method includes adding a laundry detergent to wash water to form a wash liquor and providing an effective amount of a sulfonated material selected from the group of sulfonated polymers, polysulfonated polymers, sulfonated copolymers, polysulfonated copolymers, and mixtures thereof.

The method also includes incorporating an amount of a sulfonated material into a laundry detergent such that the amount of the sulfonated material in the wash liquor is in an amount effective to inhibit the redeposition of soils and dyes on fabrics during washing as a result of polyquaternary compounds present on those fabrics. In general, the sulfonated material is incorporated with the laundry detergent in an amount to provide from about 30 ppm to about 300 ppm of the sulfonated material in the wash liquor.

In this embodiment, it is believed that the sulfonated material can be incorporated into any suitable detergent. Because it has been found that the redeposition of soils onto polyquaternary compounds on fabrics is less when the laundry detergent primarily contains anionic surfactants as the main cleaning agent, the sulfonated material is desirably incorporated with laundry detergents that primarily contain nonionic surfactants as the main cleaning agent. Suitable examples of such detergents are described in assignee's U.S. Pat. Nos. 4,429,765; 4,456,854; 5,496,486; 5,635,467; 5,714,450; 5,714,451; 5,714,452; and 5,714,456, each of which is incorporated herein by reference.

It is believed that sulfonated materials will be effective in inhibiting the redeposition of soil and dyes on fabrics after one or more polyquaternary compounds have been deposited on a fabric. It is also believed that the degree of sulfonation affects the effectiveness of the inhibition and removal properties. In other words, it is believed that a polysulfonated material will exhibit better soil inhibition and removal performance than will a monosulfonated material.

In fact, low molecular weight sulfonated hydrotropes such as sodium xylene sulfonate, sodium cumene sulfonate and sodium toluene sulfonate at levels of about 110 ppm did not provide the beneficial results achieved by the sulfonated material of the present invention. In addition, it has been found that polymers with a low level of sulfonation (on the order of less than 10% of the monomer as sulfonate) did not provide the sought after results. Therefore, the present invention contemplates the use of sulfonated materials wherein the degree of sulfonation is greater than 10%.

It should, however, be noted that when an anionic surfactant is present in the wash liquor at a level of greater than about 300 ppm, the problem of soil redeposition on the fabric as a result of the presence of polyquaternary compounds is reduced if not altogether eliminated. Thus, in this embodiment, the present invention is primarily directed to the use of laundry detergents containing primarily nonionic detergents, and preferably containing nonionic detergents as the sole surfactant.

Preferred sulfonated materials for use in the present invention include polymers containing sulfonated styrene moieties, i.e., alone, or as a copolymer with moieties derived from maleic anhydride, i.e.,

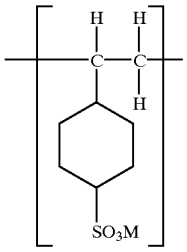

alone, or as a copolymer with moieties derived from maleic anhydride, i.e.,

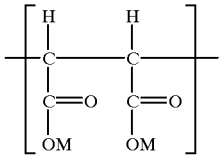

Where the sulfonated styrene moieties and maleic anhydride are copolymers, it is preferred that the sulfonated styrene moieties exceed the moieties derived from the maleic anhydride.

Preferably, the copolymers contain a mole ratio of styrene moieties to maleic anhydride derived moieties of from about 1:5 to about 5:1 and preferably about 1:3 to about 3:1, and possess a molecular weight of from 500 to 500,000, although molecular weight is not critical so long as the polymer is water-soluble. In addition, it is believed that the moiety that is sulfonated is not critical so long as the degree of sulfonation is greater than about 10%.

The copolymers of the instant invention are very soluble in water. A desirable polymer has a 1:1 mole ratio with the styrene component being fully sulfonated and the polymer having a molecular weight of about 20,000. This polymer is available from Alco Chemical under the trade name Versa TL 3.

The polymers of the present invention can be produced in different ways as is known in the art. One procedure for producing the polymers is to copolymerize styrene with maleic anhydride in the specified ratios. After the polymer is resolubilized by producing the various water-soluble salts (alkali metal), the polymer is then sulfonated in accordance with well-known techniques (note for example U.S. Pat. No. 2,764,576). The degree of sulfonation can vary but substantially complete sulfonation of the styrene moieties is preferred.

Conversion of the polymers into the water-soluble metal salts such as the alkali metal salt forms is accomplished by normal methods. Therefore, M may represent any one of or a mixture of $NH_4$, H, Na, K, etc.

As is apparent, another other manner of producing the polymers is to first sulfonate the styrene monomer utilizing a technique such as described in the above patent and then copolymerize the resulting sulfonated styrene with the maleic anhydride.

The methods and parameters of copolymerizing the two monomers are well known and illustrated by U.S. Pat. No. 2,723,956. Generally the copolymerization may be effected at temperatures from about 800 to 12° C. utilizing peroxide catalysts such as cumene hydroperoxide, benzyl peroxide, etc. in an inert medium.

BRIEF DESCRIPTION OF THE DRAWINGS

The drawings plot the degree of mousse staining or redeposition as a function of polymer added to the exemplified compositions.

The following examples illustrate, but do not limit, the present invention. Unless otherwise indicated, all parts and percentages are by weight.

EXAMPLE 1

The following formula is an example of a laundry detergent to which the sulfonated material can be added. Alternatively, the laundry detergent may be added to an appropriate amount of water to form a wash liquor and thereafter, the sulfonated material may be added to the wash liquor.

| Description | Wt. % |
|---|---|
| Cellulose Gum | 1.73 |
| Soil Dispersant | 0.62 |
| Sodium Phosophonate | 0.62 |
| Silicone Granular Defoamer | 0.37 |
| Precipitated Silica | 2.86 |
| Sodium Carbonate | 45.50 |
| Pareth-25-7 | 19.05 |
| Citric Acid | 6.50 |
| Water | 1.40 |
| Post additives | |
| Oxidatively Stable Protease | 1.45 |
| Fragrance | 0.20 |
| Fumaric Acid | 5.00 |
| Fluorescent Whitening Agent | 0.65 |
| Sodium Lauryl Sulfate | 1.94 |
| Water | 0.05 |
| Tetra Acetyl Ethylene Diamine | 2.78 |
| Sodium Perborate Monohydrate | 9.28 |
| TOTAL | 100.00 |

EXAMPLE 2

The following formula is an example of a laundry detergent to which the sulfonated material can be added. Alternatively, the laundry detergent may be added to an appropriate amount of water to form a wash liquor and thereafter, the sulfonated material may be added to the wash liquor.

| Description | Wt. % |
|---|---|
| Sodium Bicarbonate | 6.25 |
| Cotton Brightener | 0.25 |
| Silicone Granular Defoamer | 0.15 |
| Sodium Citrate | 15.00 |
| Sodium Carbonate | 38.50 |

-continued

| Description | Wt. % |
|---|---|
| Pareth-25-7 | 16.65 |
| Fatty Acid Blend | 1.00 |
| Fragrance | 0.20 |
| Precipitated Silica | 3.00 |
| Cellulose Gum | 2.00 |
| Sodium Silicate | 1.00 |
| Tetra Acetyl Ethylene Diamine | 3.00 |
| Sodium Phosphonate | 1.00 |
| Soil Dispersant | 1.00 |
| Oxidatively Stable Protease | 1.00 |
| Sodium Perborate Monohydrate | 10.00 |
| TOTAL | 100.00 |

EXAMPLE 3

The following example demonstrates that the incorporation of a particular sulfonated material, a SSMA, effectively reduced the redeposition of soils onto a fabric having a quaternary compound during the wash process. A white cotton cloth swatch was stained with a hair styling mousse that contains 0.5% Polyquaternium-4; (Cellulose, 2-hydroxyethyl ether, polymer with N,N-dimethyl-N-2-propenyl-2 propen-1-aminium chloride) and 1.0% Polyquaternium-16 (1H-Imidazolium, 1-ethenyl-3-methyl-, chloride, polymer with 1-ethenyl-2-pyrrolidinone) both polyquaternary compounds. The swatch was placed in a front-loading European style washing machine (Bauknecht Model WA3774) with a load of clothes. 42 grams of the detergent of Example 1 was added to the wash and the clothes were washed for a full cycle (using the 40° C. cycle without a prewash). When the cycle was complete, the swatch was removed and its reflectance was measured.

The same test was repeated except that 2.1 grams of Versa TL-3, a SSMA, was added to the wash in addition to the detergent of Example 1. The amount of the SSMA added provided a wash concentration of approximately 105 ppm.

Figure 1:
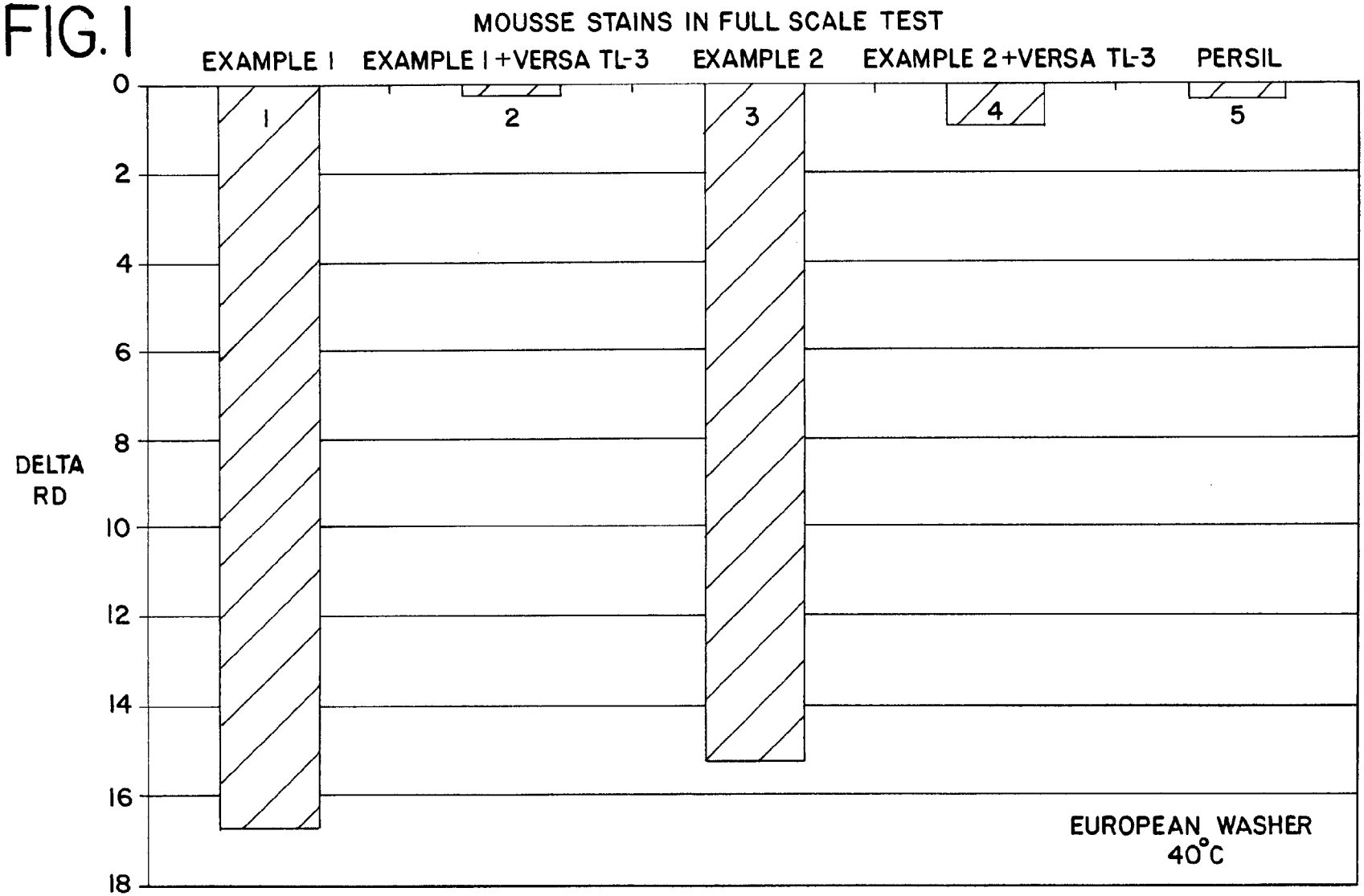

As a comparison, the same test was conducted with a commercially available European detergent, Persil Megaperls®. The Persil was added according to use directions (76.0 grams). The results of the reflectance measurements of each are shown in FIG. 1. In this figure, the less reduction in whiteness the better. It is seen that the addition of the Versa TL-3 substantially improved the whiteness of the swatch and was comparable to the results achieved by Persil.

EXAMPLE 4

A white cotton cloth swatch was stained with a hair mousse that contains 0.5% Polyquaternium-4; (Cellulose, 2-hydroxyethyl ether, polymer with N,N-dimethyl-N-2-propenyl-2 propen-1-aminium chloride) and 1.0% Polyquaternium-16 (1H-Imidazolium, 1-ethenyl-3-methyl-, chloride, polymer with 1-ethenyl-2-pyrrolidinone) both polyquaternary compounds. The swatch was placed in a front-loading European style washing machine (Bauknecht Model WA3774) with a load of clothes. 64 grams of the detergent of Example 2 was added to the wash and the clothes were washed for a full cycle (using the 40° C. cycle without prewash). When the cycle was complete, the swatch was removed and its reflectance was measured.

The same test was repeated except that 3.2 grams of Versa TL-3, a SSMA, was added to the wash in addition to the detergent of Example 2. The amount of the SSMA added provided a wash concentration of 160 ppm. Again, the results of the reflectance measurements are shown in FIG. 1. Again, the addition of the Versa TL-3 substantially improved the whiteness of the swatch and was comparable to the results achieved by Persil.

EXAMPLE 5

The following tests were conducted. Three four-inch square cotton swatches were placed in a one liter Terg-o-tometer with one four inch cotton swatch that was soiled with a mousse product containing the polyquaternary components 0.5% Polyquaternium-4; (Cellulose, 2-hydroxyethyl ether, polymer with N,N-dimethyl-N-2-propenyl-2 propen-1-aminium chloride) and 1.0% Polyquaternium-16 (1H-Imidazolium, 1-ethenyl-3-methyl-, chloride, polymer with 1-ethenyl-2-pyrrolidinone). One gram of Bandy Black Clay was added to simulate soil loading. An amount of the detergent of Example 2 was added to provide a detergent concentration of 3200 ppm. The wash conditions were simulated by providing 75 rpm agitation for 30 minutes using 40° C. water having a hardness of 14 gpg. The swatches were hand rinsed using 15° C. water having a hardness of 14 gpg.

Figure 2:
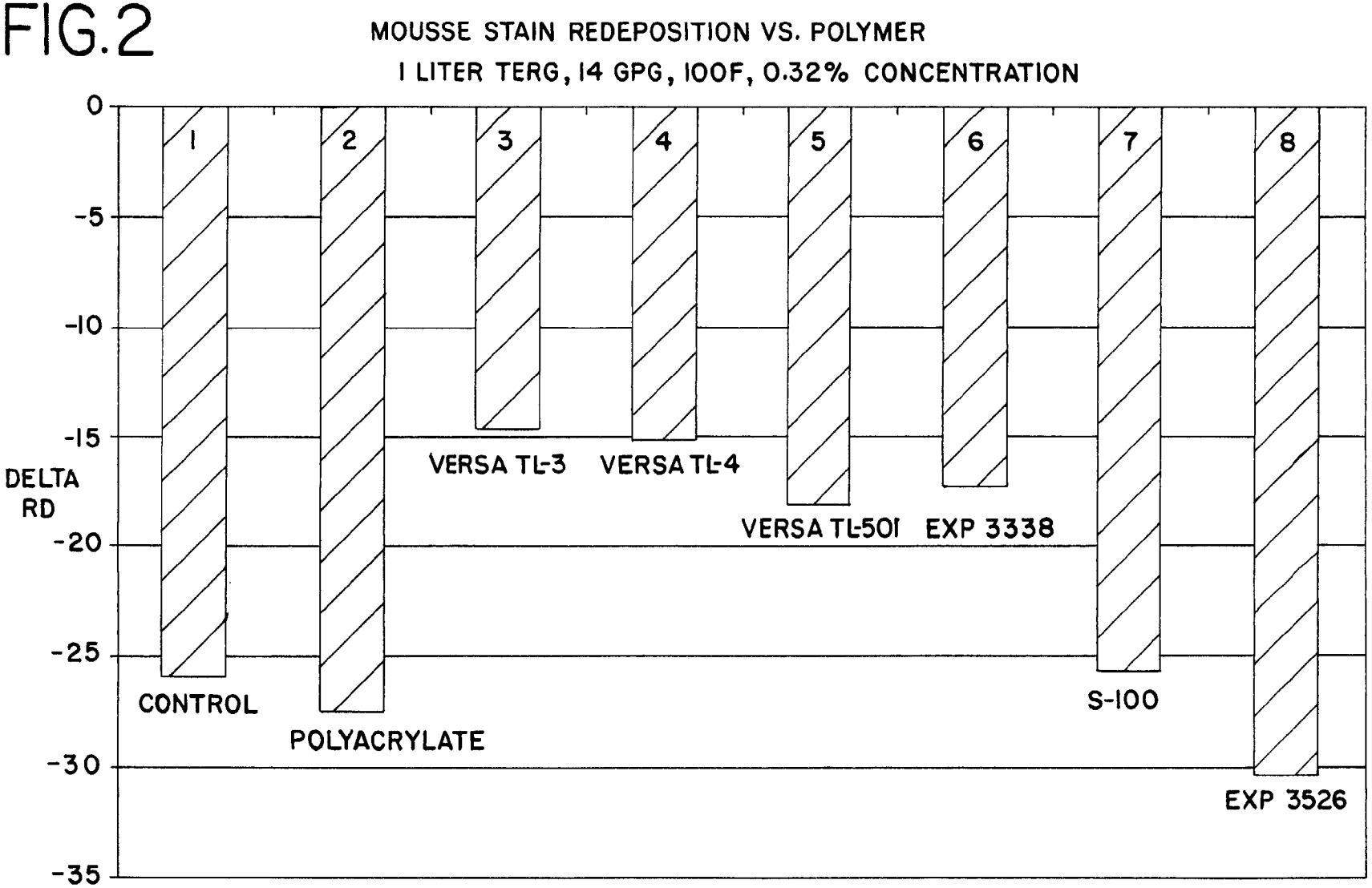

The same test was repeated except an amount of a polymer was added to provide an active amount in the wash liquor of 160 ppm. The results are shown in FIG. 2. It is seen that the Versa TL-3 and TL-4 performed the best and were substantially better than no sulfonated material.

Versa TL-3 and TL-4 are the same substance except the TL-3 is provided in a powder form whereas the TL-4 is provided as a liquid. Versa TL-501 is a very high molecular weight sulfonated styrene. EXP 3338 is a trade secret material provided by Alco Chemical. S-100 is a betaine and EXP 3526 is a polysuccinate.

EXAMPLE 6

The following tests were conducted. Three four-inch square cotton swatches were placed in a one liter Terg-o-tometer with one four inch cotton swatch that was soiled with a mousse product containing the polyquaternary components 0.5% Polyquaternium-4; (Cellulose, 2-hydroxyethyl ether, polymer with N,N-dimethyl-N-2-propenyl-2 propen-1-aminium chloride) and 1.0% Polyquaternium-16 (1H-Imidazolium, 1-ethenyl-3-methyl-, chloride, polymer with 1-ethenyl-2-pyrrolidinone). One four inch square of soil cloth of EMPA 101 (olive oil and carbon black, supplied by Test Fabrics Incorporated) was added to simulate soil loading. An amount of the detergent of Example 1 was added to provide a detergent concentration of 2100 ppm. The wash conditions were simulated by providing 75 rpm agitation for 30 minutes using 40° C. water having a hardness of 14 gpg. The swatches were hand rinsed using 15° C. water having a hardness of 14 gpg.

The same test was repeated using one gram of Bandy Black Clay to simulate soil loading.

The following polymers were added to provide an active amount in the wash liquor of 105 ppm.

| Tradename | Component | Approximate Degree of sulfonation (mole) |
|---|---|---|
| Alco Versa TL-3 | SSMA | 50% |
| Alco AL-240 | Sulfonated acrylic/maleic anhydride | 7% |

-continued

| Tradename | Component | Approximate Degree of sulfonation (mole) |
|---|---|---|
| Alco 545 | Sulfonated acrylic | 10% |
| Alco AL-725 | Styrene/acrylic | 0% |
| Alco Versa TL-77 | Sulfonated styrene | 100% |

Figure 3:
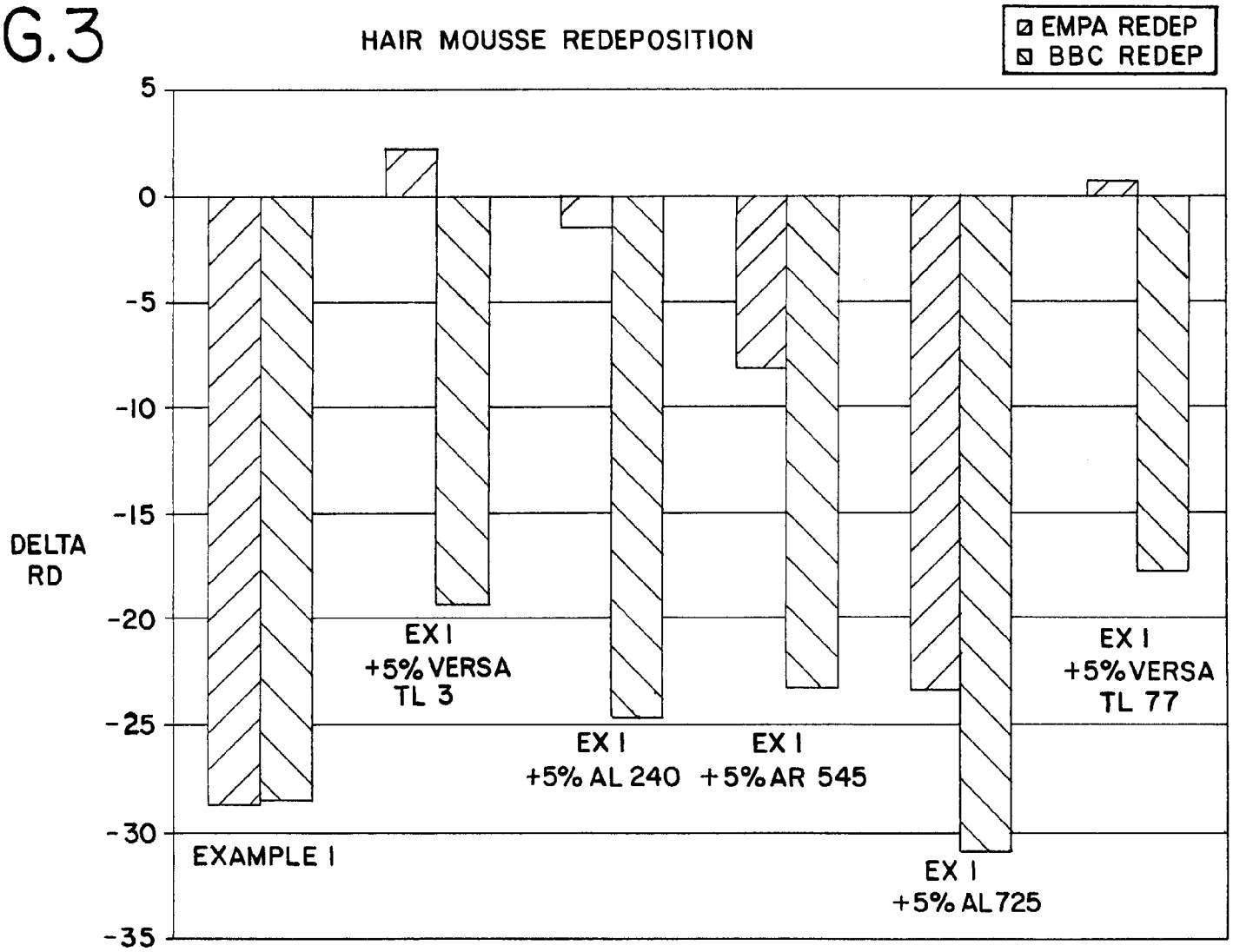

The soil redeposition results are shown in FIG. 3. It is seen that those compounds that are sulfonated exhibited better performance than those that did not. In addition, it appears that if the sulfonation occurs on an aromatic group the performance is better.

While there have been described what are presently believed to be the preferred embodiments of the invention, those skilled in the art will realize that changes and modifications may be made thereto without departing from the spirit of the invention. It is intended to claim all such changes and modifications that fall within the true scope of the invention.

What is claimed is:

1. A method of inhibiting redeposition of soil on fabrics during washing as a result of the presence of polyquaternary compounds on the fabric comprising:

a. forming a wash liquor by mixing a laundry detergent with wash water;

b. contacting a fabric containing one or more polyquaternary compounds and soil with the wash liquor; and, c. providing an amount of a sulfonated material effective to prevent redeposition of the soil on the fabric in the presence of polyquaternary compounds, wherein the sulfonated material is selected from the group of sulfonated polymers, sulfonated copolymers, and mixtures thereof, wherein the degree of sulfonation is greater than 10%, and wherein the sulfonated material is present while the fabric is in contact with the wash liquor.

2. The method of claim 1 wherein the sulfonated material is present in an amount to provide from about 30 ppm to about 300 ppm in the wash liquor.

3. The method of claim 1 wherein the sulfonated material is mixed with the laundry detergent before the laundry detergent is added to the wash water.

4. The method of claim 1 wherein the sulfonated material is a copolymer of sulfonated styrene and maleic anhydride.

5. The method of claim 4 wherein the copolymer is a 1:1 copolymer of sulfonated styrene and maleic anhydride and wherein the styrene is fully sulfonated.

6. The method of claim 1 wherein the wash liquid contains from about 500 ppm to about 10,000 ppm laundry detergent.

7. The method of claim 1 wherein the sulfonated material is selected from the group consisting of sulfonated styrene polymers, sulfonated styrene copolymers, and mixtures thereof.

8. The method of claim 1 wherein the laundry detergent contains a surfactant that is primarily a nonionic surfactant.

9. The method of claim 1 wherein the laundry detergent contains nonionic surfactants as the sole surfactant present in the laundry detergent.

* * * * *

UNITED STATES PATENT AND TRADEMARK OFFICE

CERTIFICATE OF CORRECTION

PATENT NO. : 6,310,031 B1
DATED : October 30, 2001
INVENTOR(S) : Philip G. Sliva It is certified that error appears in the above-identified patent and that said Letters Patent is hereby corrected as shown below:

Title page,
Item [56], References Cited, OTHER PUBLICATIONS, "Database" reference, delete "WIP," and substitute -- WPI, -- in its place.
"Chemical Abstracts" reference, delete "19853a," and substitute -- 198153a, -- in its place.

Signed and Sealed this

Third Day of February, 2004

JON W. DUDAS
*Acting Director of the United States Patent and Trademark Office*